US008050444B2

(12) United States Patent
Smith

(10) Patent No.: US 8,050,444 B2
(45) Date of Patent: Nov. 1, 2011

(54) ADJUSTABLE MECHANISM FOR IMPROVING HEADSET COMFORT

(76) Inventor: Dale Trenton Smith, San Jose, CA (US)

( * ) Notice: Subject to any disclaimer, the term of this patent is extended or adjusted under 35 U.S.C. 154(b) by 1322 days.

(21) Appl. No.: 11/625,238

(22) Filed: Jan. 19, 2007

(65) Prior Publication Data

US 2008/0175406 A1 Jul. 24, 2008

(51) Int. Cl.
*H04R 25/00* (2006.01)

(52) U.S. Cl. ..... 381/379; 381/370; 381/374

(58) Field of Classification Search ..... 381/370, 381/374, 376, 377, 378, 379, 383; 181/128, 181/129; 379/430; 2/209
See application file for complete search history.

(56) References Cited

U.S. PATENT DOCUMENTS

| | | | | |
|---|---|---|---|---|
| 1,167,368 A | | 1/1916 | Adams-Randall | 381/183 |
| 1,503,908 A | * | 8/1924 | Manson | 381/378 |
| 1,546,567 A | | 7/1925 | Childress | 381/183 |
| 1,552,593 A | | 9/1925 | Childress | 381/183 |
| 3,148,376 A | | 9/1964 | Aileo | 381/183 |
| 4,783,822 A | | 11/1988 | Toole | 381/187 |
| 5,185,807 A | | 2/1993 | Bergin | 381/183 |
| 5,293,647 A | | 3/1994 | Mirmilshteyn | |
| 5,792,998 A | | 8/1998 | Gardner | 181/130 |
| 5,862,241 A | | 1/1999 | Nelson | 381/379 |
| 6,163,615 A | | 12/2000 | Callahan | 381/371 |
| 6,295,366 B1 | | 9/2001 | Haller | 381/374 |
| 6,333,982 B1 | | 12/2001 | Sapiejewski | 379/430 |
| 6,952,839 B2 | | 10/2005 | Long | 2/414 |
| 2001/0017925 A1 | | 8/2001 | Ceravolo | |
| 2006/0062417 A1 | * | 3/2006 | Tachikawa | 381/378 |

FOREIGN PATENT DOCUMENTS

WO WO9002470 3/1990

* cited by examiner

*Primary Examiner* — Huyen D Le
(74) *Attorney, Agent, or Firm* — Douglas L. Weller

(57) ABSTRACT

A headphone, headset, or ear protector incorporating adjustable clamping pressure and providing configurable distribution of headband pressure. In one embodiment, the headphones, headsets, or ear protectors include a headband or neckband and at least one earcup coupled to the headband or neckband. The headphone, headset, or ear protector further includes an adjustment mechanism coupled to the headband or neckband and the at least one earcup that provides continuously variable adjustment of clamping pressure provided by the at least one earcup to the head of a user. In another embodiment, the headphone, headset, or ear protector include a headband or neckband, a first earcup coupled to the headband or neckband and a second earcup coupled to the headband or neckband. The headphone, headset, or ear protector further include an adjustment mechanism coupled to the headband or neckband and the first and second earcups that adjusts clamping pressure provided by the first and second earcups to the head of a user and a single control configured to control the adjustment mechanism. In other embodiments, the headphone, headset, or ear protector allows a user to maintain correct left/right stereo imaging while allowing the user to choose which side is placed over the right or left ear.

48 Claims, 5 Drawing Sheets

ADJUSTABLE MECHANISM FOR IMPROVING HEADSET COMFORT

CROSS-REFERENCE TO RELATED APPLICATIONS

Not applicable.

BACKGROUND

Headphones (or headsets) and ear protectors are often uncomfortable due to the pressures they exert on a user's head and ears. Headphones or ear protectors designed for noisy environments include features that reduce or eliminate environmental noise. The most common type of headset or ear protection consists of a left and right earcup that physically shields the ears from outside noise. Active or electronic noise canceling is also commonly implemented to reduce noise levels further than passive methods alone achieve.

The effectiveness of passive noise reduction or noise shielding is often dependent on how well the earcups are mated to the user's ears and head. A poor seal results in more noise. A common cause of a poor seal between an earcup and a user's head is due to the difficulty of adapting a headset to the different sizes and shapes of heads; especially the non-uniform shape surrounding the ear where the earcups mate to the head.

Headsets and ear protectors are often designed with a one-size-fits-all approach where the headset includes thick cushions which bend and conform to the user's head in order to mate the earcups to the head. The cushions are designed of material that acoustically reflects and/or absorbs sound, minimizing the sound that passes through the cushion to the inside of the earcup. This method carries the drawback that enough clamping pressure must be applied to the earcup so as to force the cushion into compliance with the head, and this necessary pressure often becomes uncomfortable over time. In order to fit a wide variety of heads, sufficient pressure must be applied to the earcups and cushions to conform the cushion to larger or smaller heads of various shapes. Thus the pressure may be more than necessary to achieve the desired noise reduction, or it may be less than needed, so the comfort level and/or the noise level is not optimized.

Another pressure point applied to the head by headphones or ear protectors is across the headband. The headband holds the headset in place so the earcups stay fixed over the ears. The headband, in combination with stirrups on each side of the headband, also provides a mechanical connection between the earcups so that sufficient pressure may be exerted to conform the earcup cushions to the head. The weight of the headphones is the primary force causing the headband to apply pressure to the top of the head. Ideally, a headset would apply the pressure evenly across the top of the head, and distribute the weight over as large an area of the head as possible. Unfortunately, headset manufacturers use a one-size-fits-all approach which applies most of the weight of the headset to a few points on the user's head, rather than distributing it evenly and across a large area.

Headphones and ear protectors typically use earcups shaped like an ear or ellipse, rather than round earcups. The earcups follow the shape of the ear as closely as possible in order to maintain a better noise seal, since variations in head shape become larger as distance from the ear increases. One problem headsets have with an ear-shaped earcup is that it prevents the user from moving the headband to the most comfortable position on their head, since moving the headband also rotates the earcup around the ear. If a user moves the headband to a comfortable position, the earcup may no longer be aligned correctly with the ear. Thus, it is often undesirable for the user to necessarily change the width, length, or shape of the headband when the user adjusts clamping pressure because the shape of the headband is a separate factor affecting comfort. It is desirable for shape and pressure to be adjustable in isolation of each other. Further, it is often desirable to have a single control for adjusting clamping pressure of both earcups, rather than a separate control for each earcup. However, typical headphones often require a separate control for each earcup or cause the adjustment of shape and pressure to not be adjustable in isolation of each other.

Many headphones have a cord, microphone, or other feature on one side of the headphone. The feature may be on the wrong side for maximum comfort and convenience. For example if the user is a pilot, the headset cord may be on the right side of the headset while the headset jacks in his aircraft are on the left, causing the cord to cross his lap. Another example is if the microphone boom is on the left side of the headset, and interferes with an oxygen boom which is also on the left. Some headset manufacturers simply allow the headset to be turned around, placing the cord and microphone on the opposite side; however this causes the right and left audio to be swapped causing right audio in the left ear and vis-versa. For a pilot, this can be a problem since some Traffic Collision Avoidance Systems (TCAS) send verbal traffic warnings to the right earphone if another aircraft is detected on the pilot's right or 3 o'clock position. Thus the stereo spatial direction the pilot hears the warning coming from in his headset is the direction he should look to see the threat.

BRIEF SUMMARY

The principles of the present invention relate to headphones, headsets, or ear protectors incorporating adjustable clamping pressure and providing configurable distribution of headband pressure. In one embodiment, the headphones, headsets, or ear protectors include a headband or neckband and at least one earcup coupled to the headband or neckband. The headphones, headsets, or ear protectors further include an adjustment mechanism coupled to the headband or neckband and the at least one earcup that provides continuously variable adjustment of clamping pressure provided by the at least one earcup to the head of a user.

In another embodiment, the headphones, headsets, or ear protectors include a headband or neckband, a first earcup coupled to the headband or neckband and a second earcup coupled to the headband or neckband. The headphones, headsets, or ear protectors further include an adjustment mechanism coupled to the headband or neckband and the first and second earcups that adjusts clamping pressure provided by the first and second earcups to the head of a user and a single control configured to control the adjustment mechanism.

A further embodiment includes a headband or neckband for a headphone, headset, or hearing protector that includes one or more rows and one or more columns configured for receiving one or more cushions. A method for selecting the size of the one or more cushions to be installed in one or more rows and columns includes an act placing the head contour plate on a user's head and applying pressure to form the head contour plate to the shape of the head, an act of placing the head contour plate under the headband or neckband, and an act of identifying locations where cushions of various sizes are to be placed based on the shape of the head contour plate.

An additional embodiment discloses a headset, headphone or hearing protector that includes a headband or neckband and an earcup. The headphones, headsets, or ear protectors further include a stirrup that couples the earcup to the headband or neckband. The stirrup includes multiple mounting positions for mounting the stirrup to the headband or neckband at two or more angles.

A final embodiment discloses a headset, headphone or hearing protector that includes a headband or neckband, a first earcup including a first speaker, a second earcup including a second speaker, a first audio input and a second audio input. One or more switches are also included for selecting whether the first speaker is driven by the first or second audio input and whether second speaker is driven by the audio input not selected to drive the first audio input.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description that follows, and in part will be obvious from the description, or may be learned by the practice of the embodiments disclosed herein. The features and advantages of the embodiments disclosed herein may be realized and obtained by means of the instruments and combinations particularly pointed out in the appended claims. These and other features of the embodiments disclosed herein will become more fully apparent from the following description and appended claims, or may be learned by the practice of the embodiments disclosed herein as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

The principles of the present invention relate to headphones, headsets, or ear protectors incorporating adjustable clamping pressure and providing configurable distribution of headband pressure. In one embodiment, the headphones, headsets, or ear protectors include a headband or neckband and at least one earcup coupled to the headband or neckband. The headphones, headsets, or ear protectors further include an adjustment mechanism coupled to the headband or neckband and the at least one earcup that provides continuously variable adjustment of clamping pressure provided by the at least one earcup to the head of a user.

In another embodiment, the headphones, headsets, or ear protectors include a headband or neckband, a first earcup coupled to the headband or neckband and a second earcup coupled to the headband or neckband. The headphones, headsets, or ear protectors further include an adjustment mechanism coupled to the headband or neckband and the first and second earcups that adjusts clamping pressure provided by the first and second earcups to the head of a user and a single control configured to control the adjustment mechanism.

A further embodiment includes a headband or neckband for a headphone, headset, or hearing protector that includes one or more rows and one or more columns configured for receiving one or more cushions. A method for selecting the size of the one or more cushions to be installed in one or more rows and columns includes an act placing the head contour plate on a user's head and applying pressure to form the head contour plate to the shape of the head, an act of placing the head contour plate under the headband or neckband, and an act of identifying locations where cushions of various sizes are to be placed based on the shape of the head contour plate.

An additional embodiment discloses a headset, headphone or hearing protector that includes a headband or neckband and an earcup. The headphones, headsets, or ear protectors further include a stirrup that couples the earcup to the headband or neckband. The stirrup includes a multiple mounting positions for mounting the stirrup to the headband or neckband at two or more angles.

A final embodiment discloses a headset, headphone or hearing protector that includes a headband or neckband, a first earcup including a first speaker, a second earcup including a second speaker, a first audio input and a second audio input. One or more switches are also included for selecting whether the first speaker is driven by the first or second audio input and whether second speaker is driven by the audio input not selected to drive the first audio input.

Figure 1:
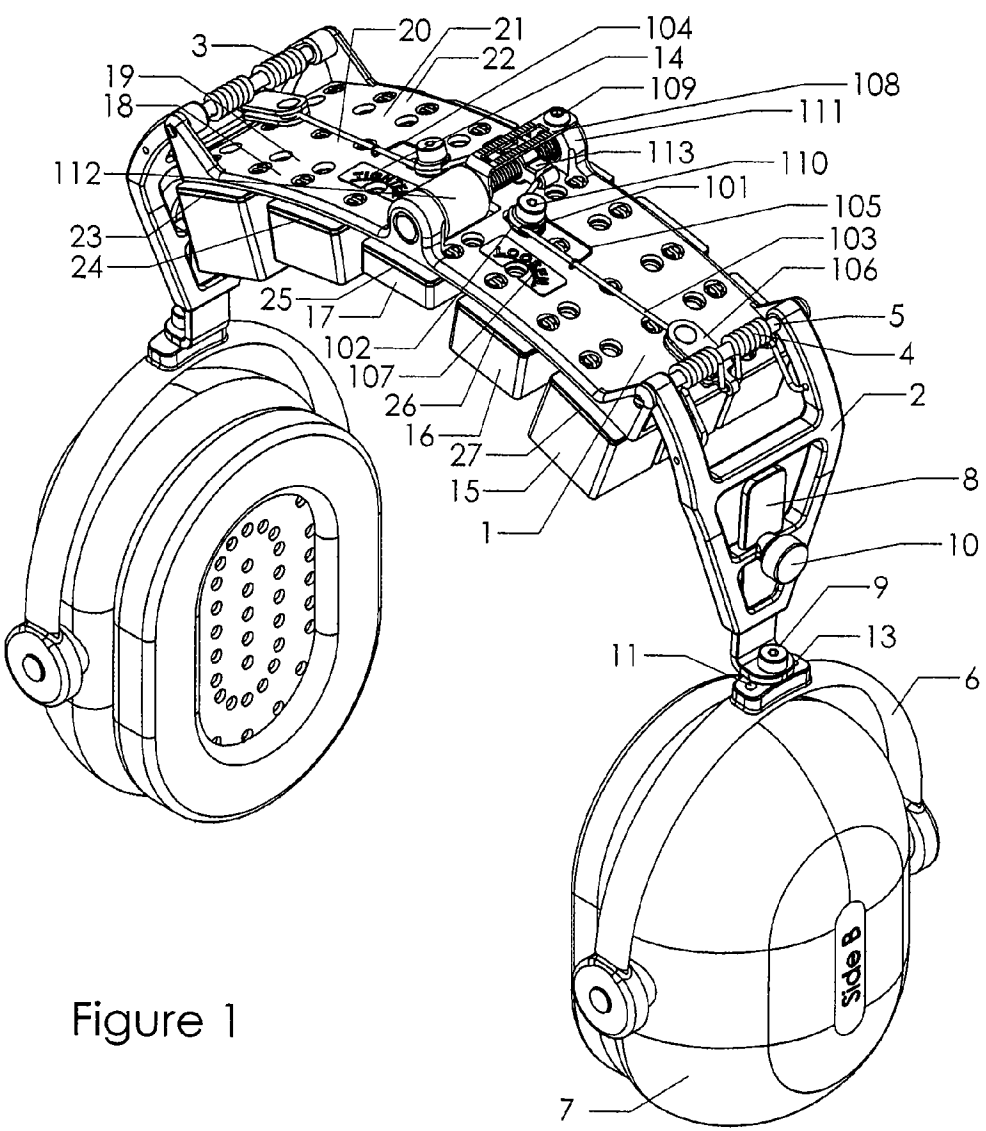
FIG. 1 is a drawing of a headphone which allows single-knob adjustment of clamping force using cables to pull on the earcups through a spring.

Turning now to the figures, FIG. 1 shows a headphone, headset, or ear protector incorporating adjustable clamping pressure and providing configurable distribution of headband pressure (weight). As shown, FIG. 1 includes a rigid headband or neckband 1 (herein after referred to as "headband 1" for simplicity), support swing arm 2 and earcup 7. In some embodiments, rigid headband 1 may have a length of 3 inches or greater, preferably 6 inches, in its longest direction although other lengths may also be implemented. Since both sides of the headset are identical, only side B is discussed in detail. SideA is on the left side of FIG. 1, and sideB is on the right side. Note that although many of the elements are only described for sideB, corresponding elements with identical functionality typically exist for sideA. Note that in this description and in the claim, "rigid" is defined to mean that the headband does not bend noticeably as clamping pressure is adjusted.

Clamping pressure against the users head is applied to earcup 7 by torsion spring 4, which is wound clockwise. Clamping pressure is applied to the earcup on sideA by sideA torsion spring 3 which is wound counter-clockwise. Torsion spring 4 provides rotational force to swing arm 2, which connects to earcup 7 through stirrup blade 8 and a stirrup 6. Earcup 7 rotates on a horizontal axis in stirrup 6, and stirrup 6 rotates on a vertical axis on stirrup blade 8 around stirrup screw 9. When stirrup blade screw 10 is loosened, stirrup blade 8 may be adjusted up or down so that the earcups may be vertically aligned over the user's ears. Once correct vertical alignment is found, stirrup blade screw 10 is tightened to hold stirrup blade 8 in place.

Stirrup 6 has three threaded holes near its apex for connecting to the stirrup blade via stirrup screw 9. The three threaded holes are drilled at different angles so that the stirrup 6 may be mounted to the stirrup blade 8 at one of three angles using one of the holes. When stirrup screw 9 is screwed into stirrup 6 using the center hole of the three holes, as is shown in FIG. 1, the earcup 7 will be vertically aligned with the stirrup blade 8. When the stirrup screw 9 is screwed into hole 11 in stirrup 6, vertical alignment of earcup 7 will typically be 10 degrees clockwise off vertical alignment with stirrup blade 8. When the stirrup screw 9 is screwed into hole 13 in stirrup 6, vertical alignment of earcup 7 will typically be 10 degrees counterclockwise off vertical alignment with stirrup blade 8. The user may thus assemble the headset to provide earcups at different angles to provide the comfort advantages discussed further below with respect to FIG. 3. Although the disclosed invention requires tools to change the angle that the stirrup 6 mounts to the stirrup blade 8, in some embodiments the stirrup screw 9 may be replaced with a spring-loaded pin that latches the stirrup in place, thus allowing the user to adjust the mounting angle of the stirrup without tools.

Figure 2:
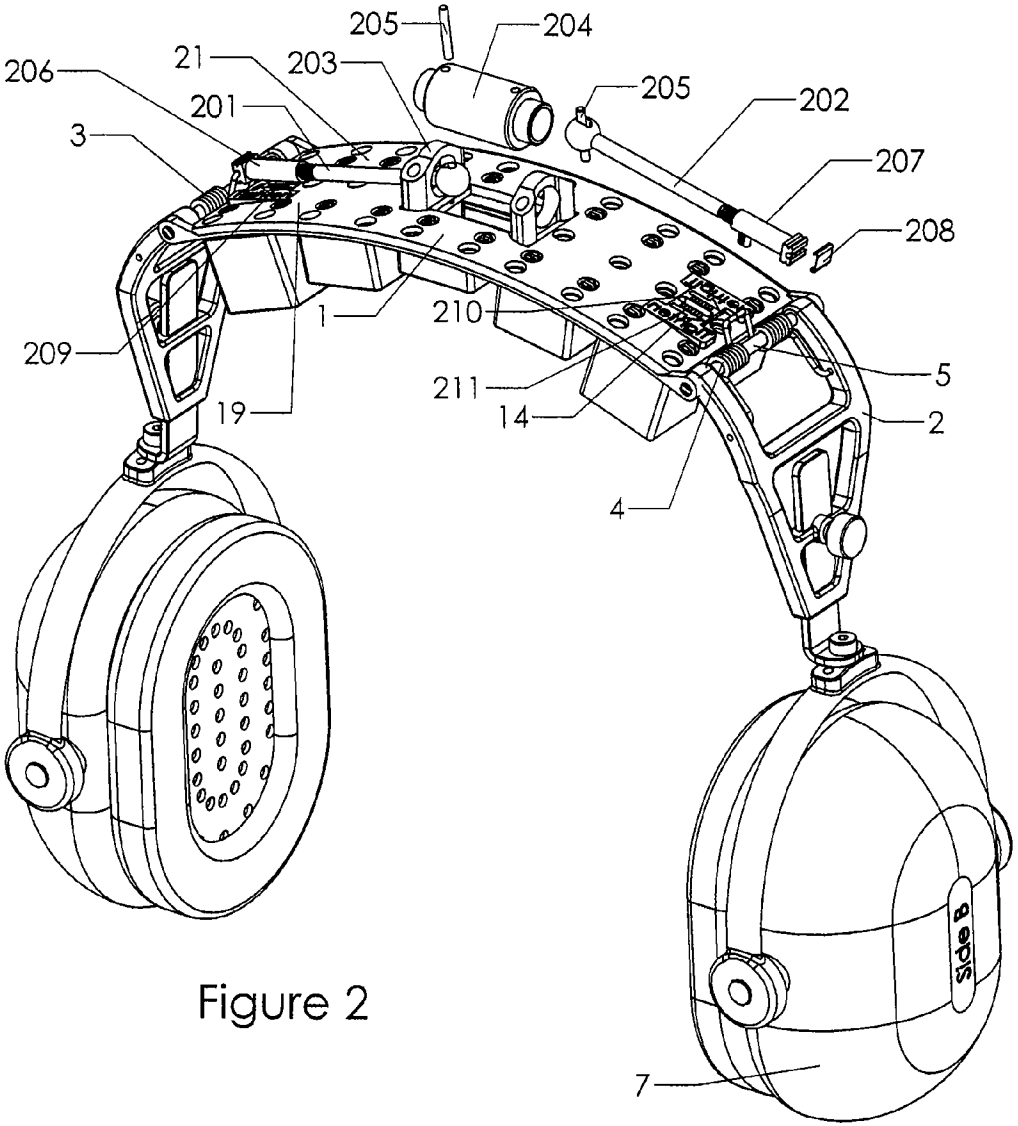
FIG. 2 is a drawing of a headphone which allows single-knob adjustment of clamping force using driveshafts to push on springs which apply force to the earcups.

As further shown in FIG. 1, headband 1 has rows and columns for the insertion of cushions. The headband rows are spaced such that three rows of one inch square cushions may be placed in row one 18, row three 20, and row five 22, as illustrated in FIG. 1. Other embodiments allow for two rows of cushions to be placed in row two 19 and row four 21 as illustrated in FIG. 2. Although headband 1 is two inches wide, the principles of the present invention accommodate users who prefer a three inch wide headband, as well as users who want a two inch wide headband, or a one inch wide headband using only row three 20. A wider headband may provide greater distribution of the weight of the headset and reduce the pressure applied by each cushion. A narrower headband may use fewer cushions, thus slightly reducing the overall weight, which may be a more important factor for some users than the pressure applied by individual cushions.

Figure 4:
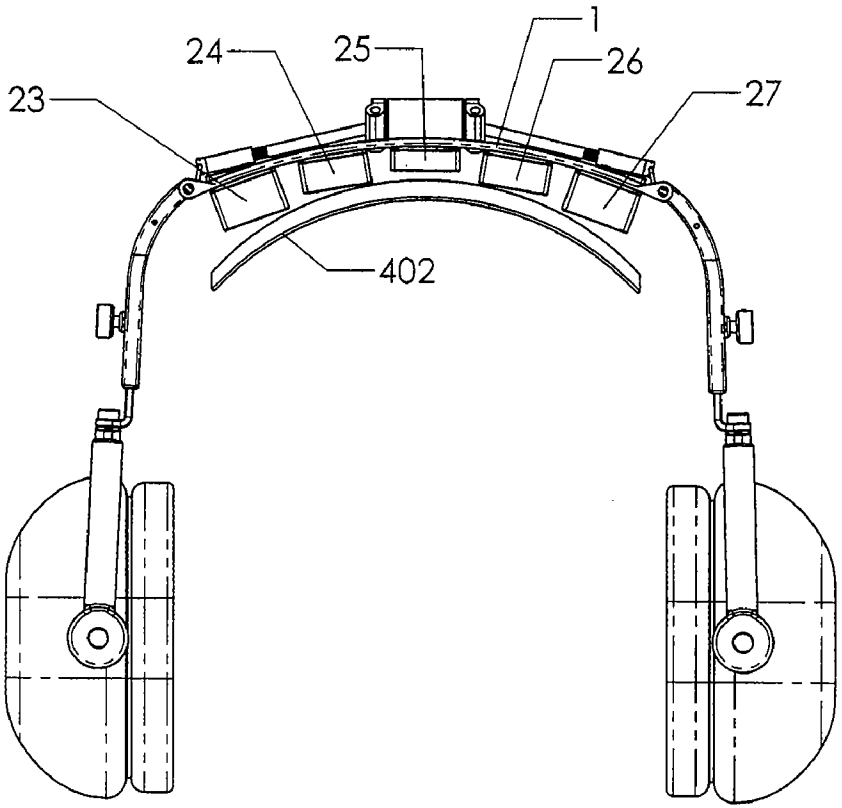
FIG. 4 is a drawing of a contour plate bent to conform to a users head and then used as a reference for selecting the height and location of cushions on the headband of a headphone.
Figure 4:
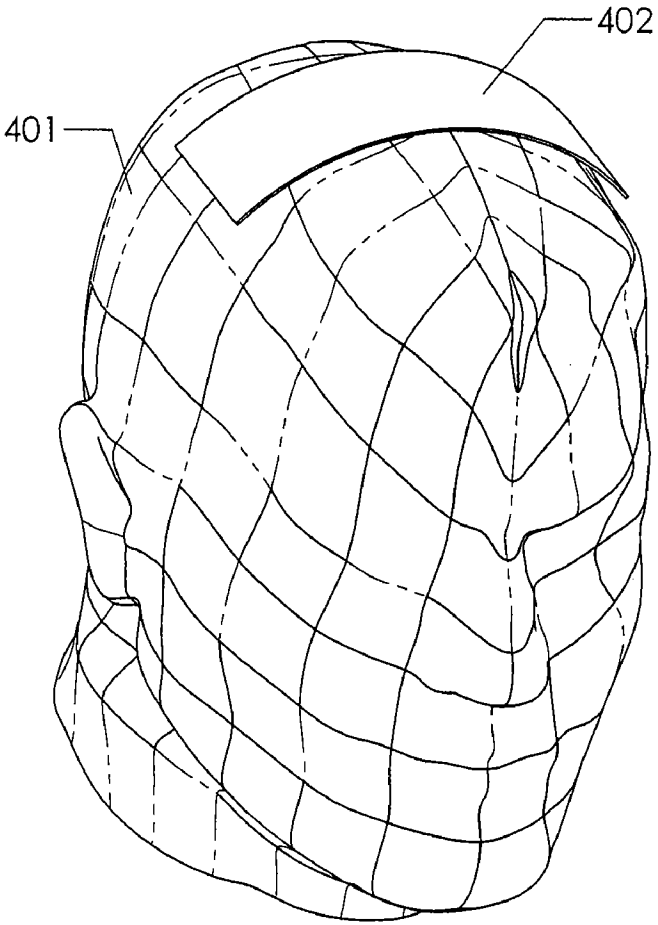

Referring again to FIG. 1, the first row 18 has five cushions inserted with a tall cushion 15 in column one 23 and column five 27. The first row 18 has a short cushion 17 in column three 25, and has a medium height cushion 16 in column two 24 and column four 26. This configuration customizes the headband for a head that has a smaller radius across the top than the average head. All the rows may use the same pattern of cushion heights as row one 18, or the other rows may use different cushion heights; desirable if the user's head is not consistent in shape from row to row or front to back. FIG. 4 described in more detail to follow provides more detail on how the cushions may be selected by the user.

FIG. 1 also shows a mechanism that allows headset clamping pressure to be adjusted while the headset is being worn. This mechanism may be applied to either a headband or a neckband depending on the headset design it is integrated into. Torsion spring 4 applies inward rotational force to swing arm 2, which pivots on the same axis that torsion spring 4 rotates on. The amount of clamping pressure applied by torsion spring 4 for a given position of swing arm 2 can be increased or decreased by changing the relative radial position of the center of the torsion spring 4, which is attached to cable termination 106. As cable 103 pulls cable termination 106 inward, additional inward force is exerted on swing arm 2, thus increasing the pressure applied to the user's head by earcup 7. This process is mirrored on the opposite side of the headset (sideA) resulting in equal pressure on each side.

Cable termination 106 is pulled closer to the center of headband 1 by cable 103 when cable adjuster nut 113 is moved away from knurled thumbscrew 112. As the user rotates knurled thumbscrew 112 counterclockwise, as shown by the tighten label 14, the threaded shaft portion of knurled thumbscrew 112 pushes cable adjuster nut 113 away from the knurled thumbscrew 112, thus pulling cable 103 through cable roller 101. As the user rotates knurled thumbscrew 112 clockwise, as shown by the loosen label 107, the threaded shaft portion of knurled thumbscrew 112 pulls cable adjuster nut 113 toward the knurled thumbscrew 112, thus allowing the torsion spring 4 to pull the cable back through cable roller 101 and lessening the clamping pressure placed on the user's head by earcup 7. A similar process is performed by the elements of sideA.

The earcup 7 is much farther from the spring pivot pin than where the cable termination 106 attaches to the sideB torsion spring 4. The ratio of these two distances determines the amount of force which the cable termination 106 must apply to the sideB torsion spring 4 for each pound of force applied by the earcup 7 to the user's head. The distance of the earcup 7 to the spring pivot pin 5 may change as the user adjusts the length of the stirrup blade 8 using stirrup blade screw 10. The average ratio of these two distances is approximately 20:1, thus in an average case, cable termination 106 generally should apply 20 pounds to torsion spring 4 in order to achieve 1 pound of force at the earcup 7. Also, in order for knurled thumbscrew 112 to be easily rotated by the user, the force applied by the user generally should be significantly less than the 20 pounds needed at sideB torsion spring 4. This reduction in force at knurled thumbscrew 112 is accomplished as rotational force is converted to linear force at the threads connecting knurled thumbscrew 112 to cable adjuster nut 113.

The width of the user's head also affects the amount of force applied by earcup 7. A wider head will cause more rotation of torsion spring 4 than a narrow head, resulting in greater force by the earcup to the user's head. In some embodiments, the range of adjustment provided by knurled thumbscrew 112 and cable adjuster nut 113 is chosen such that the pressure applied by the earcup 7 to the user's head is in the range of 4 ounces to 24 ounces across head widths of 130 mm for a small head to 170 mm for a large head. Thus, user heads of all sizes will be able to adjust earcup 7 pressure for the right balance between noise reduction and comfort.

Cable retainer saddle 102 ensures that cable 103 stays on cable roller 101 even if swing arm 2 is folded in and cable 103 slackens. SideB cable tension spring 105 takes up any slack as an extra precaution against the cable 103 coming off cable roller 101. The sideA cable tension spring 104 is wound the opposite direction from the sideB cable tension spring 105. Cable roller screw 110 attaches cable roller 101, cable retainer saddle 102, and sideB cable tension spring 105 to the headband 1.

Thumbscrew bushing 111 fits into a bushing holder feature at the rear of headband 1 and is held in place by pressure gauge screw 109. Thumbscrew bushing 111 makes it possible to insert knurled thumbscrew 112 into the circular features of headband 1 which hold it. Knurled thumbscrew 112 is prevented from coming out by the pressure placed on it by sideB torsion spring 4 and sideA torsion spring 3 via cables 103 and cable adjuster nut 113. Headband 1 places the spring pivot pin 5 above cable termination 106 so that when the cable 103 is pulled by cable adjusting nut 113, the torsion spring 4 applies more pressure to earcup 7.

A portion of cable adjuster nut 113 forms a pointer which protrudes through a slot in pressure gauge 108 in order to indicate on a graduated scale the amount of pressure the headset is currently adjusted to provide. Pressure gauge 108 is held in place at one end by pressure gauge screw 109, and at the other end by a hole in pressure gauge 108 which the threaded shaft of knurled thumbscrew 112 goes through. The pressure gauge 108 provides a visual indicator to the user before the headset is worn that the headset is set to the users preference. Some users may find it easier to adjust the headset clamping pressure before wearing it, with minor adjustments occurring while wearing it. User's may also choose to optimize the headset for noise reduction during initial use, and decide to readjust later while wearing it to increase noise and decrease clamping pressure. A significant advantage is that user's can easily adjust the headset to tradeoff noise for clamping pressure, depending on which factor causes greater discomfort at any moment of time.

As an alternative embodiment, the sideB torsion spring 4 may be eliminated completely by making the swing arm 2 out of a spring-like material instead of a rigid material. In this embodiment the cable 103 or cable termination 106 would attach directly to the swing arm 2 at a point below the swing arm's pivot point at spring pivot pin 5. Thus the flexure of the swing arm 2 would apply the clamping pressure to the user's head instead of sideB torsion spring 4.

FIG. 2 shows a headset or ear protector incorporating an alternative embodiment for user adjustment of clamping pressure while the headset is being worn. FIG. 2 shows how a headset may be implemented using driveshafts to push on both swing arms through springs, instead of cables which pull on the swing arms through springs as described in the embodiment of FIG. 1. Some components of the headset in FIG. 2 are exploded out of their normal position to provide better visibility of the individual components. The exploded view is primarily on sideB, so sideA may still be used to view how the components interact in a fully assembled and functional headset.

FIG. 2 shows a driveshaft mechanism that allows headset clamping pressure to be adjusted while the headset is being worn. This mechanism may be applied to either a headband or a neckband depending on the headset design it is integrated into. Torsion spring 4 applies inward rotational force to swing arm 2, which pivots on the same axis as torsion spring 4. The amount of clamping pressure applied by torsion spring 4 for a given position of swing arm 2 can be increased or decreased by changing the relative radial position of the center of the torsion spring 4, which is attached to sideB cylindrical pushrod 207 by pushrod end clip 208. As sideB driveshaft 202 screws out of the internal threads of sideB cylindrical pushrod 207, the outward force exerted on torsion spring 4 is translated across the spring pivot pin 5 into inward force on swing arm 2, thus increasing the inward pressure applied to the user's head by earcup 7. This process is mirrored on the opposite side of the headset (sideA) resulting in equal pressure on each side.

As part of mirroring the process on the two sides, the threads are cut in the opposite direction for sideA driveshaft 201 and sideA cylindrical pushrod 206, from the thread direction used for sideB driveshaft 202 and sideB cylindrical pushrod 207. SideB driveshaft 202 and sideA driveshaft 201 are rotated by flexible joint pin 205 as the user rotates knurled cylinder 204. A ball joint forms the interface between the driveshafts and the knurled cylinder 204 so that the driveshafts may rotate about a different axis than the knurled cylinder 204. The ball joint at the end of the driveshafts includes a slot for flexible joint pin 205. By using a slot instead of a hole for the flexible joint pin 205, the driveshaft is given some freedom in its axis of rotation, while being rotationally fixed to the flexible joint pin 205 and the knurled cylinder 204. Knurled cylinder 204 is held at each end in its rotation position by knurled cylinder bushings 203. The knurled cylinder bushings 203 are screwed to the headband 1 after the driveshafts and flexible joint pin 205 are inserted into the knurled cylinder 204.

One detail that generally should be addressed in implementing the driveshaft embodiment of the headset with adjustable clamping pressure is the possibility that the user may rotate the knurled cylinder too far, thus causing the driveshaft 202 to become unscrewed completely from the cylindrical pushrod 207, or be screwed in to the cylindrical pushrod 207 too far, causing it to jam. This possibility is addressed by limiting the travel of the cylindrical pushrods 206 and 207 with a protrusion molded into them. The protrusion runs into the end of a travel limiter before the cylindrical pushrod can become unscrewed or before the driveshafts 201 and 202 are screwed too far into the cylindrical pushrods 206 and 207. When the protrusions on the cylindrical pushrods 206 and 207 run into the end of the travel limiters 209 and 210, the user is able to detect the increase in force required to turn the knurled cylinder 204 and know that the end has been reached. The protrusions and travel limiters are designed strong enough that the amount of force placed on the protrusions by a normal user's rotation of the knurled cylinder 204 is insufficient to break the protrusions off the cylindrical pushrods 206 and 207.

The sideB travel limiter 210 is a feature molded or machined into sideB of the headband. On either side of the sideB travel limiter 210 is a sideB pressure gauge 211 which is graduated to show the currently configured clamping pressure by referencing the graduations to the current position of the protrusion on the sideB cylindrical pushrod 207. A tighten label 14 shows that the end closest to the swing arm indicates greater clamping pressure. An identical travel limiter feature 209 is built into sideA of the headband and works in conjunction with the protrusion on the sideA cylindrical pushrod 206. The sideA travel limiter 209 includes a graduated pressure gauge just like sideB.

In order to apply an inward force to the swing arm 2 as the sideB driveshaft 202 and sideB cylindrical pushrod 207 pushes outward, the sideB cylindrical pushrod 207 pushes on torsion spring 4 on the top side of spring pivot pin 5, which is also the pivot axle for swing arm 2. The outward force on the top side of torsion spring 4 causes it to apply inward force to swing arm 2, which rotates on and hangs under spring pivot pin 5. SideA torsion spring 3 is wound in the opposite direction from sideB torsion spring 4 so that the spring forces are mirrored rather than in the same direction.

The earcup 7 is much farther from the spring pivot pin than where the sideB cylindrical pushrod 207 attaches to the sideB torsion spring 4. The ratio of these two distances determines the amount of force which the sideB cylindrical pushrod 207 generally should apply to the sideB torsion spring 4 for each pound of force applied by the earcup 7 to the user's head. The distance of the earcup 7 to the spring pivot pin 5 may change as the user adjusts the length of the stirrup blade 8 using stirrup blade screw 10. The average ratio of these two distances is approximately 20:1, thus in an average case, sideB cylindrical pushrod generally should apply 20 pounds to torsion spring 4 in order to achieve 1 pound of force at the earcup. Also, in order for knurled cylinder 204 to be easily rotated by the user, the force applied by the user generally should be significantly less than the 20 pounds needed at sideB torsion spring 4. This reduction in force at knurled cylinder 204 is accomplished as rotational force is converted to linear force at the threads connecting sideB driveshaft 202 to sideB cylindrical pushrod 207.

The width of the user's head also affects the amount of force applied by earcup 7. A wider head typically will cause more rotation of torsion spring 4 than a narrow head, resulting in greater force by the earcup to the user's head. The range of adjustment provided by knurled cylinder 204, sideB driveshaft 202, and sideB cylindrical pushrod 207 is chosen such that the pressure applied by the earcup 7 to the user's head is in the range of 4 ounces to 24 ounces across head widths of 130 mm for a small head to 170 mm for a large head. Thus user heads of all sizes will be able to adjust earcup pressure for the right balance between noise reduction and comfort.

As an alternative embodiment, the sideB torsion spring 4 may be eliminated completely by making the swing arm 2 out of a spring-like material instead of a rigid material. In this embodiment sideB cylindrical pushrod 207 would push directly on swing arm 2 at a point above the swing arm's pivot point at spring pivot pin 5. Thus the flexure of the swing arm 2 would apply the clamping pressure to the user's head instead of sideB torsion spring 4.

FIG. 2 shows headband 1 configured with two rows of cushions in row two 19 and row four 21, which provides a two inch wide surface of cushions against the users head. Note that in the description and in claims, "continuously variable adjustment" is defined to mean adjustment that has infinite granularity. In other words, unlike conventional headsets, the principles of the present invention are not limited a few discrete adjustment pressure levels or positions. Instead, by pulling the cables or pushing with the shafts as previously described, the amount of clamping pressure provided by the earcups may be adjusted in continuous manner at infinite granularity of positions and pressure levels. Further note that in the description and in the claims, two elements are "coupled" together if they are directly coupled or if they are indirectly coupled through one or more intervening elements. In addition, clamping pressure is meant to mean the pressure exerted by the earcup on a portion of the head.

Figure 3:
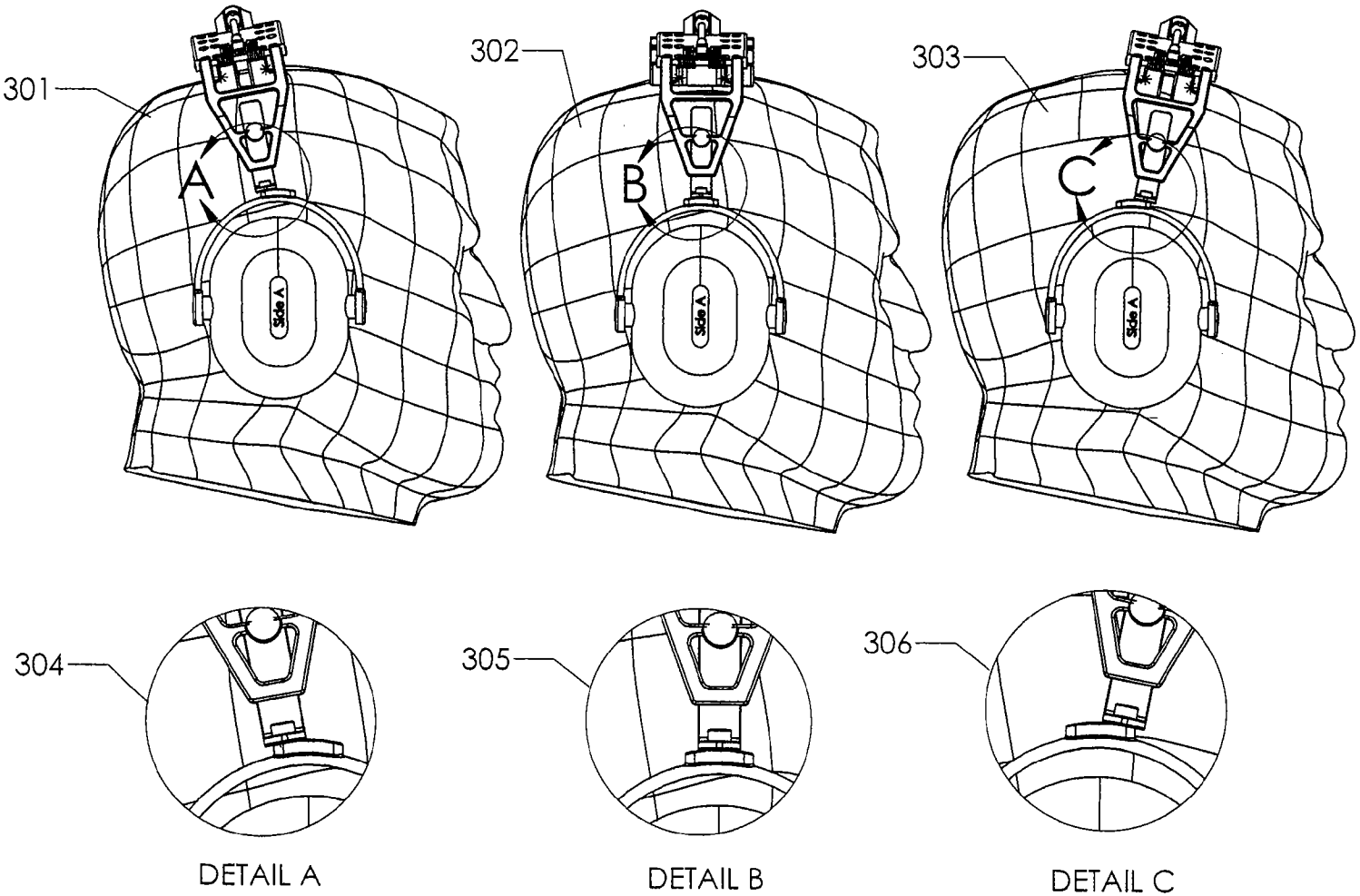
FIG. 3 is a drawing of a headphone with a headband that can be configured to sit toward the front or back of the users head without rotating the earcups.

FIG. 3 shows an embodiment of how the headband of the headset may be configured for placement at different positions on the user's head without changing the angle at which the elliptical earcups are positioned over the user's ears. The position of the headband with respect to the earcups is changed by rotating the angle of attachment of the earcup to the stirrup. Three mounting holes (see FIG. 1), each at a different angle, are provided on each stirrup so that the user may configure the position of the headband on his head while maintaining vertical alignment of the earcups. A user preferring 10 degrees back 301 would mount the stirrup to the headset using the mounting hole to the rear of the stirrup, as shown in FIG. 3 detail A 304. A user preferring zero degrees back 302, which provides no angular offset between the earcup and the headband, would mount the stirrup to the headset using the mounting hole in the middle of the stirrup, as shown in FIG. 3 detail B 305. A user preferring 10 degrees forward 303 would mount the stirrup to the headset using the mounting hole in the front of the stirrup, as shown in FIG. 3 detail C 306. In this way the headset may be configured to provide the user with the greatest headband comfort without moving the earcups from the position which provides the best noise isolation and greatest ear comfort.

As shown in FIG. 3, the user preferring 10 degrees back 301 has configured his headset with two rows of cushions, thus his headband is two inches wide. The user preferring zero degrees back 302 has configured his headset with three rows of cushions, thus the headband is three inches wide and distributes the headset weight across a larger area of the users head.

FIG. 4 shows a method for selecting the size of the cushions to be installed in each row and column of headband 1. A user 401 places a head contour plate 402 which is about the same size as headband 1 on his head where he will wear headband 1. The head contour plate 402 in some embodiments is 0.040 inches thick and is made of aluminum which can be easily formed by hand using more than 10 pounds of force, and which holds its shape under normal handling where less than a few pounds of force are placed on it. Other materials such as steel are also suitable. Using his hand, the user applies pressure to the head contour plate 402 forming it to the shape of his head. Once the head contour plate 402 is an accurate model for the shape of the users head 401 where the headband will sit, the user then places the head contour plate 402 under the headband 1 and visually identifies locations where taller cushions will be required, or where shorter cushions are necessary in order to evenly distribute the weight of the headband 1 on the users head 401. After the cushions have been installed and are distributing the weight of the headset evenly over the area of the headband, the user may find that some locations of his head 401 are more sensitive than others. The user may choose to shorten cushions in sensitive locations in order to increase long term comfort.

Headsets may have features that are not duplicated on both sides, such as a cord or microphone that comes off one side of the headset, but not the other. It is often more convenient for the user to have a one-sided feature on a specific side. The invention allows a user to choose whether earcup 7 is worn over the right ear or the left ear, by designating the earcups as "SideA" and "SideB" rather than "Right" and "Left" as stereo headsets are normally labeled. Another feature which ensures the user has the same options whether he wears earcup 7 over his right or left ear is the symmetry of selecting the angle at which the stirrup blade 8 mounts to the stirrup 6. Another special feature of the invention allows sideB earcup 7 to be worn over either the right or left ear even when mission critical information requires proper right and left stereo imaging. One such example is modern Traffic Collision Avoidance Systems (TCAS) which provide a pilot with collision alerts for the right side of the aircraft in his right ear, and threats detected on the left side of the aircraft are provided in his left ear, thus reducing the pilot's reaction time to the threat. Such a binaural system is described in U.S. Pat. No. 5,861,846.

Figure 5:
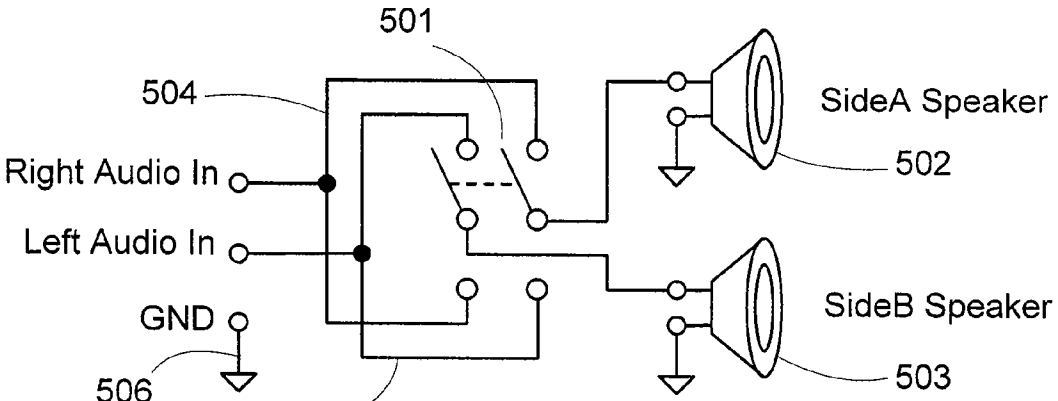
FIG. 5 is a schematic drawing of a stereo headphone using a single switch to swap the speakers driven by the right and left audio input.
Figure 6:
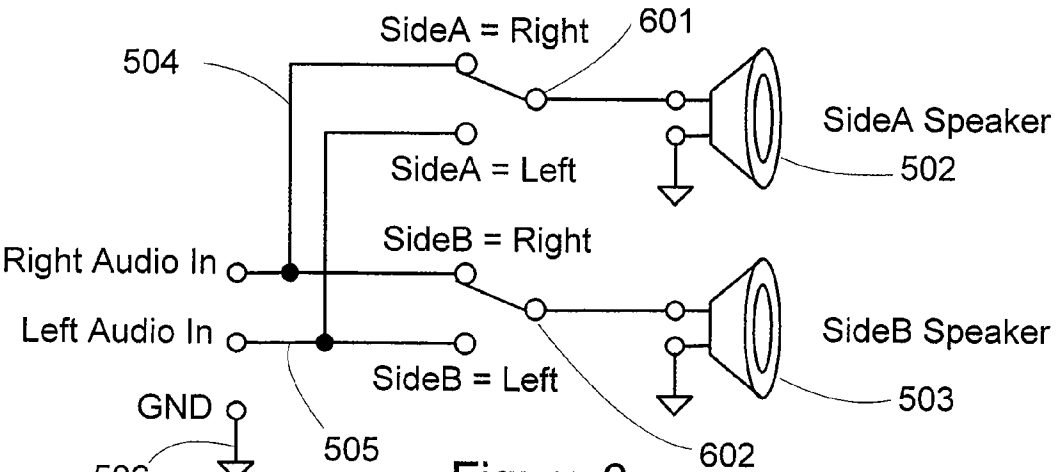
FIG. 6 is a schematic drawing of a stereo headphone using two separate switches to independently select the right or left audio source for each speaker.

FIG. 5 and FIG. 6 show solutions to the problem of maintaining correct stereo imaging while allowing the user to select which earcup will be on the right or left. As shown in FIG. 5, a double-pole, double-throw stereo swap switch 501 is built into the headset wiring. When thrown in one direction, the stereo swap switch connects right audio in 504 to sideA speaker 502, and connects left audio in 505 to sideB speaker 503. The return ground 506 remains connected to the speaker ground at all times. Thus the user may use the stereo swap switch 501 to configure the headset to use either sideA or sideB as the right speaker, and the other side as the left speaker.

FIG. 6 shows an alternative for configuring the sideA speaker 502 and sideB speaker 503, which carries the advantage of also configuring the headset to be used with a mono audio output. Two separate single-pole, double throw switches are used to individually configure each speaker to use the desired audio source. As shown in FIG. 6, sideA switch 601 selects whether the audio source for SideA speaker 502 is right audio in 504, or left audio in 505. SideB switch 602 selects whether the audio source for SideB speaker 503 is right audio in 504, or left audio in 505. If the stereo headset is plugged into a mono audio jack providing audio on only the right audio in 504 contact, the user may configure both the sideA switch 601 and the sideB switch 602 to connect to the right audio in 504 signal. Alternatively, the sideA switch 601 and sideB switch 602 may both also be configured to connect to the left audio in 505 if mono sound is only coming in on the left audio in 505 contact.

Accordingly, the principles and embodiments of the present invention disclosed herein provide for an improvement in the art of adjustable headsets. For example, embodiments herein disclosed allow a user to easily adjust the pressure of headset earphones while wearing the headset so that he or she can choose the optimum balance between clamping pressure and passive noise reduction. Additional embodiments disclosed herein allow for the distribution of headband pressure evenly across a user's head and to locations chosen by the user while maintaining correct earcup alignment. Further embodiments disclosed herein allow features on one side of the headset to easily be moved to the other side without impacting comfort or functionality, while maintaining stereo audio with correct right/left directionality.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. An adjustable headset, headphone or hearing protector comprising:

a rigid headband or neckband of at least 3" length in its longest direction;

at least one swing arm coupled to the headband or neckband;

at least one earcup coupled to the swing arm; and an adjustment mechanism coupled to the headband or neckband and the at least, one swing arm configured to provide continuously variable adjustment of clamping pressure that a torsion spring provides by the at least one swing arm and earcup to a head of a user.

2. The adjustable headset, headphone or hearing protector in accordance with claim 1, wherein the adjustment mechanism is operable while a user is wearing the adjustable headset, headphone or hearing protector.

3. The adjustable headset, headphone or hearing protector in accordance with claim 1, wherein moving one side of the torsion spring at least partially causes the continuously variable adjustment of clamping pressure provided by the at least one earcup.

4. The adjustable headset, headphone or hearing protector in accordance with claim 3, wherein the adjustment mechanism further comprises one or more cables coupled to the torsion spring and wherein the one or more cables are configured to pull on the torsion spring to move the one side of the torsion spring.

5. The adjustable headset, headphone or hearing protector in accordance with claim 3, wherein the adjustment mechanism further comprises one or more shafts coupled to the torsion spring and wherein the one or more shafts are configured to push on the torsion spring to move the one side of the torsion spring.

6. The adjustable headset, headphone or hearing protector in accordance with claim 3, wherein the torsion spring applies inward rotational force to the swing arm that causes the swing arm to pivot on the same axis that the torsion spring rotates on.

7. The adjustable headset, headphone or hearing protector in accordance with claim 1, wherein the adjustment mechanism comprises a force control mechanism configured to convert a force provided by a user into a greater force applied close to a pivot point of the at least one earcup or to the pivot point of the swing arm.

8. The adjustable headset, headphone or hearing protector in accordance with claim 7, wherein the force control mechanism comprises one of one or more threaded screws, one or more shafts, one or more gears, or one or more levers.

9. The adjustable headset, headphone or hearing protector in accordance with claim 1 further comprising a second earcup coupled to the headband or neckband and the adjustment mechanism, the second earcup being coupled to the headband or neckband on a side opposite the at least one earcup, the adjustable headset, headphone or hearing protector further comprising:

a single user activated control configured to cause the adjustment mechanism to adjust the clamping pressure provided by the first and second earcups to the head of a user at both sides of the headband or neckband.

10. The adjustable headset, headphone or hearing protector in accordance with claim 9, wherein the user activated control comprises one of a knob, a lever, or an element configured to push or pull.

11. The adjustable headset, headphone or hearing protector in accordance with claim 1 configured to provide adjustable clamping pressure of 8 oz or less to 16 oz or more across a range of head widths from less than 145 mm to greater than 160 mm.

12. The adjustable headset, headphone or hearing protector in accordance with claim 1, additionally comprising:

a stirrup configured to couple one of the at least one earcup to the headband or neckband, wherein the stirrup includes a plurality of multiple mounting positions for mounting the stirrup to the headband or neckband at two or more angles.

13. The headset, headphone, or hearing protector in accordance with claim 12, wherein a mounting position is configured to cause the headband or neckband to sit 0 degrees back on the users head.

14. An adjustable headset, headphone or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a pressure indicator configured to indicate clamping pressure provided by the at least one earcup.

15. An adjustable headset, headphone or hearing protector comprising:

a rigid headband or neckband;

a first earcup;

a second earcup;

a first swing arm configured to couple the headband or neckband to the first earcup;

a second swing arm configured to couple the headband or neckband to the second earcup;

an adjustment mechanism coupled to the first and second earcups configured to adjust clamping pressure that at least one torsion spring provides by the first and second earcups to a head of a user; and a single control configured to control the adjustment mechanism.

16. The adjustable headset, headphone or hearing protector in accordance with claim 15, wherein the single control is operable while a user is wearing the adjustable headset, headphone or hearing protector.

17. The adjustable headset, headphone or hearing protector in accordance with claim 15, wherein the at least one torsion spring comprises a first torsion spring coupled to the first earcup and a second torsion spring coupled to the second earcup and wherein changing a reference position of the first and second torsion springs at least partially causes adjustment of clamping pressure provided by the first and second earcups, the reference position being the side of the torsion springs that does not move when the swing arms move.

18. The adjustable headset, headphone or hearing protector in accordance with claim 17, wherein the adjustment mechanism further comprises one or more cables coupled to the first and second torsion springs and wherein the one or more cables are configured to pull on the first and second torsion springs to change the reference positions of the first and second torsion springs.

19. The adjustable headset, headphone or hearing protector in accordance with claim 17, wherein the adjustment mechanism further comprises one or more shafts coupled to the first and second torsion springs and wherein the one or more shafts are configured to push on the first and second torsion springs to change the reference positions of the first and second torsion springs.

20. The adjustable headset, headphone or hearing protector in accordance with claim 17, wherein the first torsion spring applies inward rotational force to the first swing arm that causes the first swing arm to pivot on the same axis that the first torsion spring rotates on and wherein the second torsion spring applies inward rotational force to the second swing arm that causes the second swing arm to pivot on the same axis that the second torsion spring rotates on.

21. The adjustable headset, headphone or hearing protector in accordance with claim 15, wherein the adjustment mechanism comprises a force control mechanism configured to convert a force provided by a user into a greater force applied close to a pivot point of the at least one earcup or to the pivot point of the first or second swing arm.

22. The adjustable headset, headphone or hearing protector in accordance with claim 21, wherein the force control mechanism comprises one of one or more threaded screws, one or more shafts, one or more gears, or one or more levers.

23. The adjustable headset, headphone or hearing protector in accordance with claim 15, wherein the adjustment mechanism is configured to provide continuously variable adjustment of clamping pressure provided by the first and second earcups.

24. The adjustable headset, headphone or hearing protector in accordance with claim 15, wherein the single control comprises one of a knob, a lever, or an element configured to push or pull.

25. The adjustable headset, headphone or hearing protector in accordance with claim 15 configured to provide adjustable clamping pressure of 8 oz or less to 16 oz or more across a range of head widths form less than 145 mm to greater than 160 mm.

26. The adjustable headset, headphone or hearing protector in accordance with claim 15, additionally comprising:

a stirrup configured to couple the first earcup to the headband or neckband, wherein the stirrup includes a plurality of multiple mounting positions for mounting the stirrup to the headband or neckband at two or more angles.

27. An adjustable headset, headphone or hearing protector comprising:

a rigid headband or neckband;

a first earcup;

a second earcup;

a first swing arm configured to couple the headband or neckband to the first earcup;

a second swing arm configured to couple the headband or neckband to the second earcup;

an adjustment mechanism coupled to the first and second earcups configured to adjust clamping pressure provided by the first and second earcups to the head of a user;

a single control configured to control the adjustment mechanism; and, a pressure indicator configured to indicate clamping pressure provided by the first and second earcups.

28. An adjustable headset, headphone or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a headband or neckband, the headband or neckband including one or more rows and one or more columns configured for receiving one or more cushions, wherein the size of the one or more cushions to be installed in one or more rows and columns are selected by placing the head contour plate on a user's head and applying pressure to form the head contour plate to the shape of the head, placing the head contour plate under the headband or neckband and identifying locations where cushions of various sizes are to be placed based on the shape of the head contour plate.

29. The adjustable headset, headphone or hearing protector in accordance with claim 28, wherein the size of the one or more cushions to be installed in one or more rows and columns are additionally selected by attaching the various cushions to the headband or neckband, a combination of different sized cushions being used to evenly distribute weight on the user's head.

30. The adjustable headset, headphone or hearing protector in accordance with claim 28, wherein the head contour plate is comprised of a metal sheet similar in size to the headband.

31. The adjustable headset, headphone or hearing protector in accordance with claim 28, wherein the act of applying pressure to the head contour plate is performed by a user's hand.

32. The adjustable headset, headphone or hearing protector in accordance with claim 31, wherein the user's hand applies more than 3 pounds of force to the head contour plate.

33. An adjustable headset, headphone or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a stirrup configured to couple one of the at least one earcup to the headband or neckband, wherein the stirrup includes a plurality of multiple mounting positions for mounting the stirrup to the headband or neckband at two or more angles;

wherein the multiple mounting positions allow for adjusting the headband or neckband to sit further forward of backward on a user's head without changing the angle at which the earcup sits on the user's head.

34. An adjustable headset, headphone, or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a stirrup configured to couple one of the at least one earcup to the headband or neckband, wherein the stirrup includes a plurality of multiple mounting positions for mounting the stirrup to the headband or neckband at two or more angles;

wherein the plurality of multiple mounting positions comprise mounting holes located at the apex of the stirrup.

35. An adiustable headset, headphone, or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a stirrup configured to couple one of the at least one earcup to the headband or neckband, wherein the stirrup includes a plurality of multiple mounting positions for mounting the stirrup to the headband or neckband at two or more angles;

wherein a mounting position is configured to cause the headband or neckband to sit 10 degrees back on the users head.

36. An headset, headphone, or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a stirrup configured to couple one of the at least one earcup to the headband or neckband, wherein the stirrup includes a plurality of multiple mounting positions for mounting the stirrup to the headband or neckband at two or more angles;

wherein a mounting position is configured to cause the headband or neckband to sit 10 degrees forward on the users head.

37. An adjustable headset, headphone, or hearing protector comprising:

a rigid headband or neckband of at least 3" length in its longest direction;

at least one swing arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user; and a stirrup configured to couple one of the at least one earcup to the headband or neckband, wherein the stirrup includes a plurality of multiple mounting positions for mounting the stirrup to the headband or neckband at two or more angles;

wherein the at least one earcup comprises a first earcup and a second earcup and wherein the stirrup is a first stirrup, the headset, headphone, or hearing protector further comprising:

a second stirrup configured to couple the second earcup to the headband or neckband, wherein the second stirrup includes a plurality of multiple mounting positions for mounting the second stirrup to the headband or neckband at two or more angles such that headband or neckband may be adjusted to sit further forward or further backward on a user's head without changing the angle at which the first and second earcups sit on the user's head.

38. An adjustable headset, headphone or hearing protector comprising:

a rigid headband or neckband of at least 3" length in its longest direction;

at least one swinq arm coupled to the headband or neckband;

at least one earcup coupled to the swing arm;

an adjustment mechanism coupled to the headband or neckband and the at least one swing arm configured to provide continuously variable adjustment of clamping pressure provided by the at least one swing arm and earcup to the head of a user:

a first audio input;

a second audio input; and one or more switches;

wherein the at least one earcup comprises a first earcup including a first speaker, and a second earcup including a second speaker; and wherein the one or more switches select whether the first speaker is driven by the first or second audio input and whether the second speaker is driven by the audio input not selected to drive the first audio input.

39. The headset, headphone, or hearing protector in accordance with claim 38, wherein the first and second audio inputs are stereo audio inputs and wherein the one or more switches is a double-pole, double-throw switch configured in a first configuration to connect the first stereo audio input to the first speaker and to connect the second stereo audio input to the second speaker and configured in a second configuration to connect the first stereo audio input to the second speaker and to connect the second stereo audio input to the first speaker.

40. The headset, headphone, or hearing protector in accordance with claim 38, wherein the one or more switches are two single-pole, double-throw switches configured in a first configuration to connect the first audio input to the first speaker and to connect the second audio input to the second speaker, configured in a second configuration to connect the first audio input to the second speaker and to connect the second audio input to the first speaker, configured in a third configuration to connect the first and second speakers to the first audio input, and configured in a fourth configuration to connect the first and second speakers to the second audio input, wherein the third and fourth configurations allow for the use of mono audio inputs.

41. The headset, headphone, or hearing protector in accordance with claim 38 further comprising:

a first stirrup configured to couple the first earcup to the headband or neckband;

a second stirrup configured to couple the second earcup to the headband or neckband; and wherein the first and second stirrups include a plurality of multiple mounting positions for mounting the first and second stirrups to the headband or neckband at two or more angles.

42. The headset, headphone, or hearing protector in accordance with claim 41, wherein the plurality of multiple mounting positions allow for adjusting the headband or neckband to sit further forward of backward on a user's head without changing the angle at which the first and second earcups sit on the user's head.

43. The headset, headphone, or hearing protector in accordance with claim 41, wherein the plurality of multiple mounting positions of the first and second stirrups comprise three mounting holes located at the apex of the first and second stirrups.

44. The headset, headphone, or hearing protector in accordance with claim 41, wherein a first mounting position of the first and second stirrups is configured to cause the headband or neckband to do one of the following:

sit 10 degrees back on the users head;

sit 0 degrees back on the users head;

sit 10 degrees forward on the users head.

45. An adjustable headset, headphone or hearing protector comprising:

a rigid headband or neckband;

a first earcup;

a second earcup;

a first swing arm configured to couple the headband or neckband to the first earcup;

a second swing arm configured to couple the headband or neckband to the second earcup;

an adjustment mechanism coupled to the first and second earcups configured to adjust clamping pressure provided by the first and second earcups to the head of a user;

a single control configured to control the adjustment mechanism; and a headband or neckband, the headband or neckband including one or more rows and one or more columns configured for receiving one or more cushions, wherein the size of the one or more cushions to be installed in one or more rows and columns are selected by placing the head contour plate on a user's head and applying pressure to form the head contour plate to the shape of the head, placing the head contour plate under the headband or neckband and identifying locations where cushions of various sizes are to be placed based on the shape of the head contour plate.

46. The adjustable headset, headphone or hearing protector in accordance with claim 45, wherein the size of the one or more cushions to be installed in one or more rows and columns are additionally selected by attaching the various cushions to the headband or neckband, a combination of different sized cushions being used to evenly distribute weight on the user's head.

47. An adjustable headset, headphone or hearing protector, comprising:

a rigid headband or neckband;

a first earcup;

a second earcup;

a first swing arm configured to couple the headband or neckband to the first earcup;

a second swing arm configured to couple the headband or neckband to the second earcup;

an adjustment mechanism coupled to the first and second earcups configured to adjust clamping pressure provided by the first and second earcups to the head of a user; and a single control configured to control the adjustment mechanism; and a stirrup configured to couple the first earcup to the headband or neckband, wherein the stirrup includes a plurality of multiple mounting positions for mounting the stirrup to the headband or neckband at two or more angles, wherein the multiple mounting positions allow for adjusting the headband or neckband to sit further forward of backward on a user's head without changing the angle at which the first earcup sits on the user's head.

48. An adjustable headset, headphone or hearing protector comprising:

a rigid headband or neckband;

a first earcup;

a second earcup;

a first swing arm configured to couple the headband or neckband to the first earcup;

a second swing arm configured to couple the headband or neckband to the second earcup;

an adjustment mechanism coupled to the first and second earcups configured to adjust clamping pressure provided by the first and second earcups to the head of a user; and a single control configured to control the adjustment mechanism;

a first audio input;

a second audio input; and one or more switches;

wherein the first earcup includes a first speaker;

wherein the second earcup includes a second speaker; and wherein the one or more switches select whether the first speaker is driven by the first or second audio input and whether the second speaker is driven by the audio input not selected to drive the first audio input.

* * * * *